US009610469B2

(12) United States Patent
Mutch et al.

(10) Patent No.: US 9,610,469 B2
(45) Date of Patent: Apr. 4, 2017

(54) MUSCLE DEVELOPMENT SYSTEM

(75) Inventors: Stephen Mutch, Edinburgh (GB); Oliver Finlay, Edinburgh (GB); Brian Combe, Dalkeith (GB); Jim Ward, Peebles (GB); Ewan Maxwell, Newbridge (GB)

(73) Assignee: Spiral Innovation Limited, Edinburgh (GB)

( * ) Notice: Subject to any disclaimer, the term of this patent is extended or adjusted under 35 U.S.C. 154(b) by 286 days.

(21) Appl. No.: 13/996,558

(22) PCT Filed: Dec. 20, 2011

(86) PCT No.: PCT/GB2011/001740
§ 371 (c)(1),
(2), (4) Date: Aug. 30, 2013

(87) PCT Pub. No.: WO2012/085502
PCT Pub. Date: Jun. 28, 2012

(65) Prior Publication Data

US 2014/0148317 A1 May 29, 2014

Related U.S. Application Data

(60) Provisional application No. 61/425,377, filed on Dec. 21, 2010.

(30) Foreign Application Priority Data

Dec. 21, 2010 (GB) ..... 1021628.1

(51) Int. Cl.
*A63B 21/02* (2006.01)
*A63B 21/04* (2006.01)
(Continued)

(52) U.S. Cl.
CPC ..... *A63B 21/02* (2013.01); *A63B 21/04* (2013.01); *A63B 21/0552* (2013.01);
(Continued)

(58) Field of Classification Search
CPC ..... A63B 21/02; A63B 21/0017; A63B 21/00149; A63B 21/0016; A63B 21/04;
(Continued)

(56) References Cited

U.S. PATENT DOCUMENTS 4,861,020 A * 8/1989 Soligny, Sr. ..... A63B 21/1627 482/129
5,538,486 A * 7/1996 France ..... A63B 21/0004 177/245

(Continued)

FOREIGN PATENT DOCUMENTS

AU 2009100941 A4 1/2010
EP 1731117 A1 12/2006
KR 2020090010880 U 10/2009

OTHER PUBLICATIONS

International Searching Authority, International Search Report for International Application No. PCT/GB2011/001740, mailed Mar. 28, 2012, 4 pages, European Patent Office, The Netherlands.

(Continued)

*Primary Examiner* — Stephen Crow
*Assistant Examiner* — Garrett Atkinson
(74) *Attorney, Agent, or Firm* — Alston & Bird LLP

(57) ABSTRACT

A muscle development system comprising a clip (10) for attaching a resilient band to a fixed point; and a sleeve (16) for fitting round a body cylinder, for example arm or leg or torso. The sleeve (16) has at least one attachment device for allowing attachment of the resilient band (14) to the sleeve. The clip (10) has a body part (22) shaped to allow the resilient band (14) to be spirally or helically wound round it.

17 Claims, 8 Drawing Sheets

(51) Int. Cl.
*A63B 21/055* (2006.01)
*A63B 23/035* (2006.01)
*A63B 21/00* (2006.01)

(52) U.S. Cl.
CPC ..... *A63B 21/4001* (2015.10); *A63B 21/4007* (2015.10); *A63B 21/4013* (2015.10); *A63B 21/4021* (2015.10); *A63B 23/035* (2013.01); *A63B 21/0442* (2013.01); *A63B 2220/51* (2013.01)

(58) Field of Classification Search
CPC ..... A63B 21/1403; A63B 21/0552; A63B 21/0442; A63B 23/035; A63B 2220/51
USPC ..... 482/1, 8, 121–124, 129
See application file for complete search history.

(56) References Cited

U.S. PATENT DOCUMENTS 5,540,642 A * 7/1996 Sprague ..... A63B 23/03533 482/123
5,546,639 A * 8/1996 Lacore ..... B62J 7/08 24/129 R
5,993,362 A * 11/1999 Ghobadi ..... A63B 21/0004 482/121
6,120,423 A * 9/2000 Mackey ..... A63B 21/025 482/121
7,004,892 B2 * 2/2006 Marco ..... A63B 21/0004 434/258
7,608,026 B1 * 10/2009 Nicassio ..... A63B 21/00185 24/265 BC
7,785,243 B2 * 8/2010 Kassel ..... A63B 21/00185 482/121
7,946,006 B2 * 5/2011 Thompson ..... F16B 45/02 24/592.11
2004/0018922 A1 * 1/2004 Maiuri ..... A63B 21/0552 482/124
2004/0171466 A1 * 9/2004 Tuller ..... A63B 21/0023 482/140
2005/0176562 A1 * 8/2005 Huang ..... A63B 21/0552 482/121
2005/0282689 A1 * 12/2005 Weinstein ..... A63B 21/0552 482/124
2007/0015642 A1 * 1/2007 Demeniuk ..... A63B 21/0004 482/124
2008/0064576 A1 3/2008 Tyree
2009/0011909 A1 * 1/2009 Glisan ..... A63B 21/0552 482/129
2010/0016134 A1 1/2010 Reese
2010/0137105 A1 * 6/2010 McLaughlin ..... A63B 23/0205 482/8

OTHER PUBLICATIONS

Intellectual Property Office, Search Report under Section 17 for Application No. GB1021628.1, dated Apr. 19, 2011, 2 pages, United Kingdom.

* cited by examiner

MUSCLE DEVELOPMENT SYSTEM

CROSS REFERENCE TO RELATED APPLICATIONS

This application is a national stage application, filed under 35 U.S.C. §371, of International Application No. PCT/GB2011/001740, filed Dec. 20, 2011, which claims priority to and the benefit of U.S. Application No. 61/425,377, filed Dec. 21, 2010, and GB Application No. 1021628.1, filed Dec. 21, 2010, the contents of both of which are hereby incorporated by reference in their entirety.

BACKGROUND OF THE INVENTION

Related Field

The present invention relates to a system and device for helping develop muscle in a controlled and measured way. The invention can be used by athletes for training purposes or by patients for rehabilitation.

Description of Related Art

There is a currently well-known and frequently used item of equipment used in physical therapy, athletic training and rehabilitation called Thera-Band™. This has a thin tubing model for identical uses called Thera-Tubing™. These products are rubber resistance bands. The bands are colour coded with each different coloured band providing a different resistance load. In use, the band is held for upper arm strengthening or gripped by the hand for rehabilitation purposes or looped around the foot, ankle or thigh for lower limb rehabilitation or kicking practice. The need to grip the band or loop it around a body part limits the functionality and specificity of exercise. Whilst the bands are coded according to the general resistance afforded, the actual force achieved during exercise is unknown and can vary dramatically depending on the length, age and speed of force application.

BRIEF SUMMARY

According to the present invention there is provided a device for muscle development comprising a clip for attaching a resilient band to a fixed point; and a sleeve for fitting round a body cylinder, for example arm or leg or torso, the sleeve having at least one means for allowing attachment of the resilient band, wherein the resilient band is releasably connectable between the clip and sleeve.

By allowing the resilient band to be attached to a fixed point and to the sleeve on the human body, the need for gripping, wrapping or holding can be avoided. This allows the hand, foot or limbs to move freely allowing functional task reproduction.

The clip has a body part shaped to allow the resilient band to be securably and releasably wrapped around it. Preferably, the clip is shaped to allow the resilient band to be spirally wound round it. By spirally winding the band round the clip, grip can be maximised, and slipping avoided, but with no excessive wear or heating of the band.

The clip may have a body part shaped to allow the resilient band to be securably and releasably wrapped round it. For example, the clip may have a groove or guide for accommodating the resilient band. The body part may be shaped to allow the resilient band to be spirally or helically wound round it. The body part may have a spiral or helical groove formed on its external surface for accommodating the resilient band.

A fastener may be provided on the clip for fastening the resilient band onto a portion of the clip. The fastener may have a lever that is operable to releasably fasten the band to the clip. The lever may be spring loaded, and biased towards a fastening position.

The clip may include a load meter, for example a strain gauge. This provides force production data that gives objective information thus enabling the therapist/coach and patient/athlete to log the force output. This information can be used to provide an accurate initial baseline assessment in addition to subsequent retest comparisons to evaluate the effects of injury or training. This potential for objectively recording the pull on the tubing as a number enables the therapist and patient/athlete to log forces through the tubing and chart improvement. This is advantageous in clinics or hospital settings and in the sporting environment.

The clip may include a processor for processing data from the load meter. The clip may include a memory wherein the processor is operable to cause data to be stored in a memory.

The clip may include mechanical and/or electrical components to record peak and average force generation through the resilient band.

The sleeve may be made of fabric. For example, the sleeve may comprise a flexible or elasticated fabric that enables it to be put on independently allowing for home use in addition to clinical application.

Flexible loops or clips may be positioned along the length of the sleeve to allow the resilient band to be connected. The loops or clips may be on the front and/or back and/or top and/or bottom and/or inside and/or outside of the sleeve.

According to another aspect of the invention, there is provided a clip for use in an exercise environment for attaching a resilient band to a fixed point, wherein the clip has a body part shaped to allow the resilient band to be securably and releasably wrapped around it.

The body part may be shaped to allow the resilient band to be wound round it. For example the clip may have a groove or guide on an external surface for accommodating the resilient band. The body part may have a spiral or helical groove formed on its external surface for accommodating the resilient band.

A fastener may be provided on the clip for fastening the resilient band onto a portion of the clip. The fastener may have a lever that is operable to releasably fasten the band to the clip. The lever may be spring loaded, and biased towards a fastening position.

The clip may include a load meter, for example a strain gauge for measuring force generation through the band. Peak and/or average force generation through the resilient band may be measured.

A processor may be provided for processing data from the load meter. Also, a memory may be provided for storing data from the load meter.

A wireless transmitter may be provided for transmitting data from the clip to a remote location. Additionally, a wireless receiver may be provided for receiving instructions from to a remote location.

According to yet another aspect of the invention there is provided an exercise/muscle development system comprising multiple clips and at least one sleeve for fitting round at least one body cylinder, the clips being adapted to allow a resilient band to be releasably connected to the at least one sleeve.

Typically, multiple body sleeves are provided for connecting round different parts of the body, each body sleeve being paired with a clip.

Using sleeves and clips on different body parts, complex exercises can be done and monitored, for example kicking exercises. This is advantageous.

At least one of the clips and preferably all may have a body part shaped to allow the resilient band to be wound round it. For example the clip may have a groove or guide on an external surface for accommodating the resilient band. The body part may have a spiral or helical groove formed on its external surface for accommodating the resilient band.

A fastener may be provided on at least one of the clips, and preferably all, for fastening the resilient band onto a portion of the clip. The fastener may have a lever that is operable to releasably fasten the band to the clip. The lever may be spring loaded, and biased towards a fastening position.

At least one of the clips may include a load meter, for example a strain gauge for measuring force generation through the band. Peak and/or average force generation through the resilient band may be measured.

At least one of the clips may include a processor for processing data from the load meter. Also, a memory may be provided for storing data from the load meter.

At least one of the clips may include a wireless transmitter for transmitting data from the clip to a remote location. Additionally, a wireless receiver may be provided for receiving instructions from to a remote location.

BRIEF DESCRIPTION OF THE FIGURES

Various aspects of the invention will now be described by way of example only and with reference to the accompanying drawings, of which:

FIG. 4(*b*) is a front view of the dummy clip of FIG. 4(*a*);

FIG. 7(*b*) shows front, rear and side elevations of the clip of FIG. 7(*a*);

DETAILED DESCRIPTION OF VARIOUS EMBODIMENTS

Figure 1:
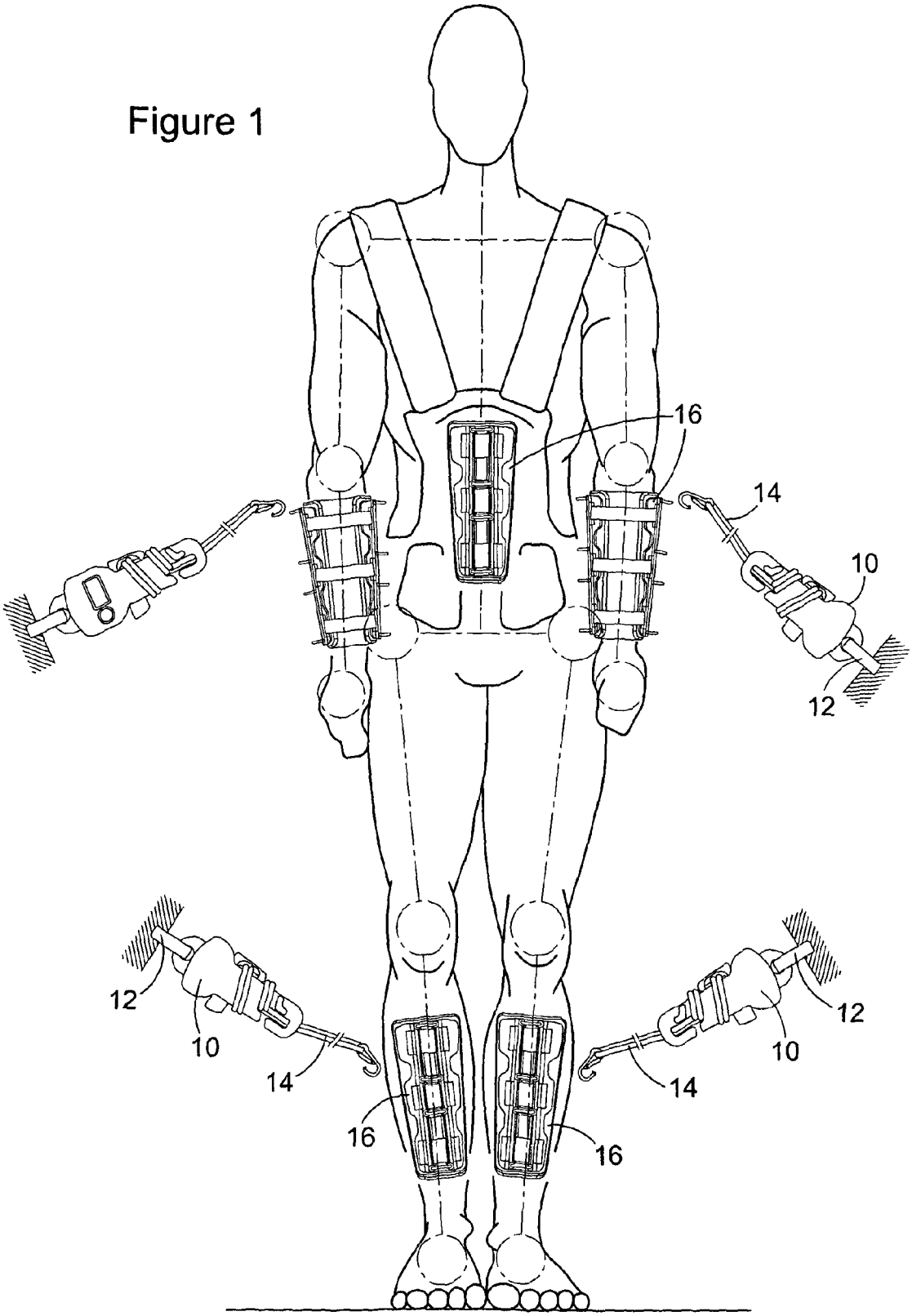
FIG. 1 is a front view of a patient wearing a torso and leg/arm based attachments that form part of a resistance band based exercise system.

FIG. 1 shows a system in accordance with the invention for helping a patient or sportsperson exercise. This has three basic parts: a clip 10 for securing to a fixed point 12; a resilient band 14, for example Thera-tubing, and a sleeve 16 for fitting round a body part. In the example shown in FIG. 1, four clips 10 are provided and sleeves 16 are fitted round the person's forearms, thighs, lower legs and torso.

Figure 2A:
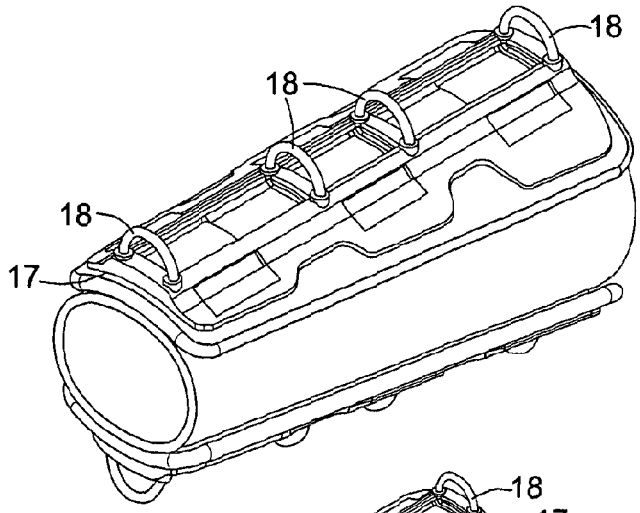
FIGS. 2(*a*) to (*c*) are views of a leg/arm sleeve for use in the system of FIG. 1.
Figure 2B:
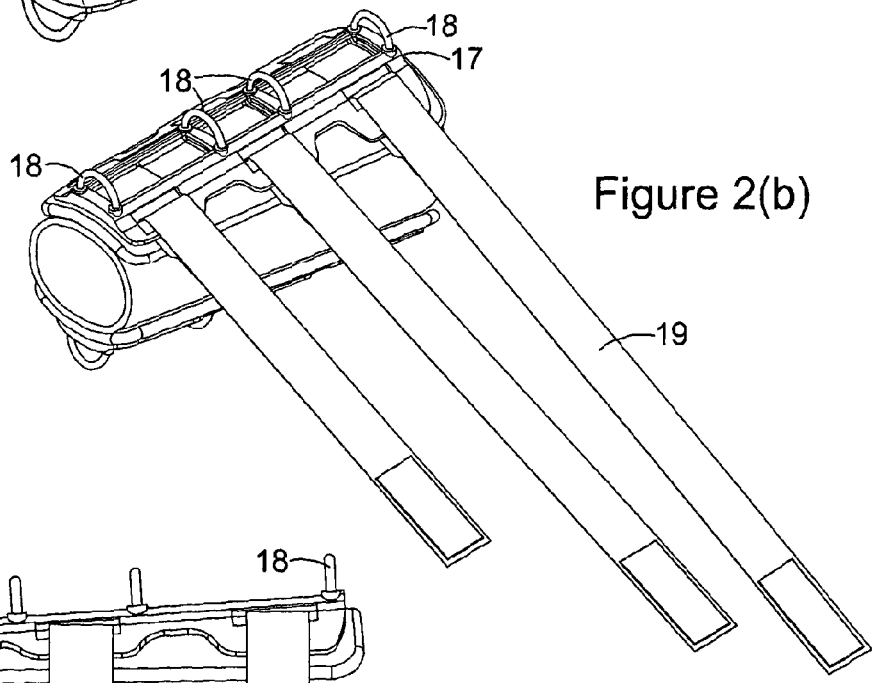
Figure 2C:
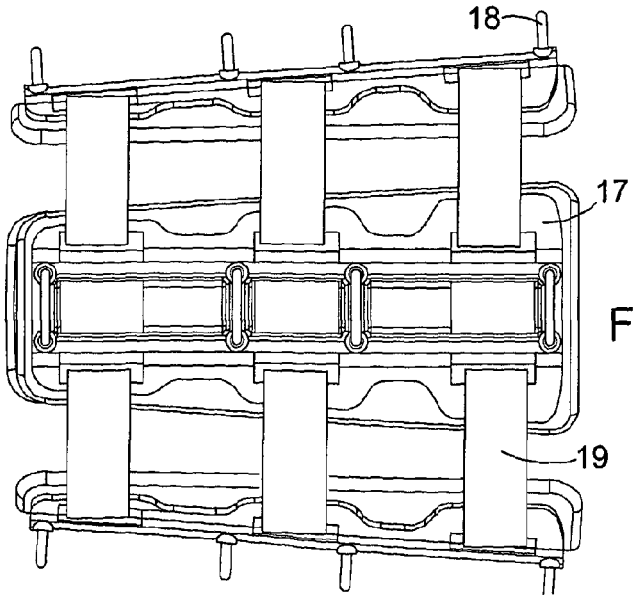

The torso sleeve has an adjustable harness (made from, for example, fabric/neoprene/webbing) that has shoulder straps; a waistband section and front, side and rear anchor points for allowing one or more of the resilient bands 14 to be connected, for example using a carabineer attachment. The forearm attachment is shown in more detail in FIG. 2. This has an upper padded section and a lower padded section each having on its external surface a semi-rigid plastic moulding 17. An elasticated expanding section connects the upper and lower sections. The lower and upper leg attachments are similarly arranged.

For each of the forearm and leg attachments, the semi-rigid plastic mouldings 17 comprise a flexible plastic injection moulding with a rigid centre section. Four anchor points 18 are provided on the rigid centre section. These are made of flexible material to accommodate twisting. A fixing position is also provided for adjustable straps 19 and side wings to reduce the amount of skin contact. Three adjustable straps 19 are provided in the example shown in FIG. 2. These are made of webbing and stitched Velcro to allow for easy fastening. Each limb attachment provides a secure anchor point 18 for the flexible band 14 in multiple positions. In use, the sleeves 16 are fitted round the user's arm or leg and secured using the adjustable straps 19. Strain is distributed through the structure, so that the sleeves do not twist or distort in operation.

Figure 3:
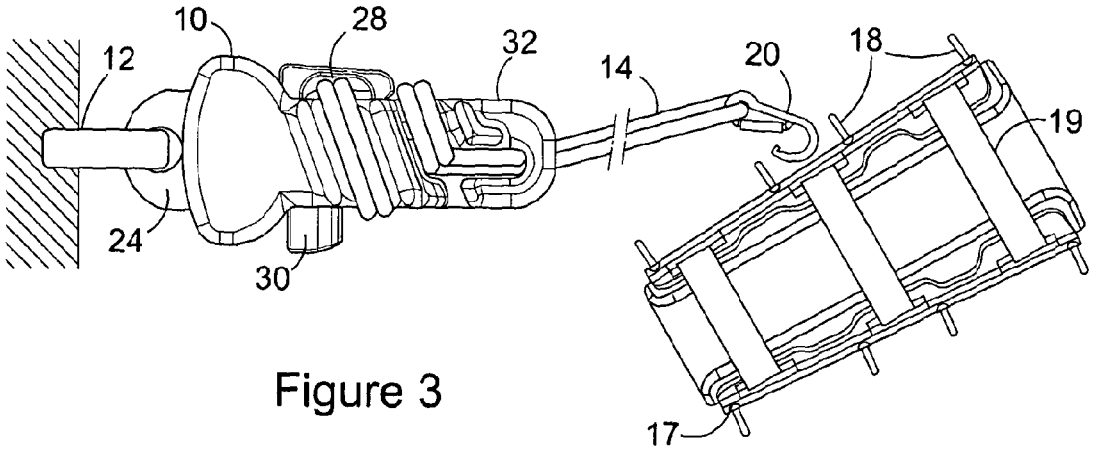
FIG. 3 is a front view of a dummy clip with flexible tubing attached and shown in proximity to a leg/arm sleeve.

FIG. 3 shows the flexible band 14 and clip in more detail. In this example, a length of flexible tubing 14 is folded and a fastener or hook 20 (for example a carabineer) is connected to its looped end and fixed to one of the anchors 18 on a sleeve attachment 16. This can be done at a number of different positions. The open end of the folded rubber tubing 14 is releasably attached to the clip 10, so it can be securely held. Whilst there is no tension in the system it is possible to adjust the length of the rubber tubing 14. When there is tension in the system the tubing 14 is held securely in place. Multiple rubber tubes 14 may be attached to one limb attachment. Equally, multiple limb attachments and/or a torso attachment 16 could be used, so that arm and leg and body movements can be exercised and monitored simultaneously.

Figure 5:
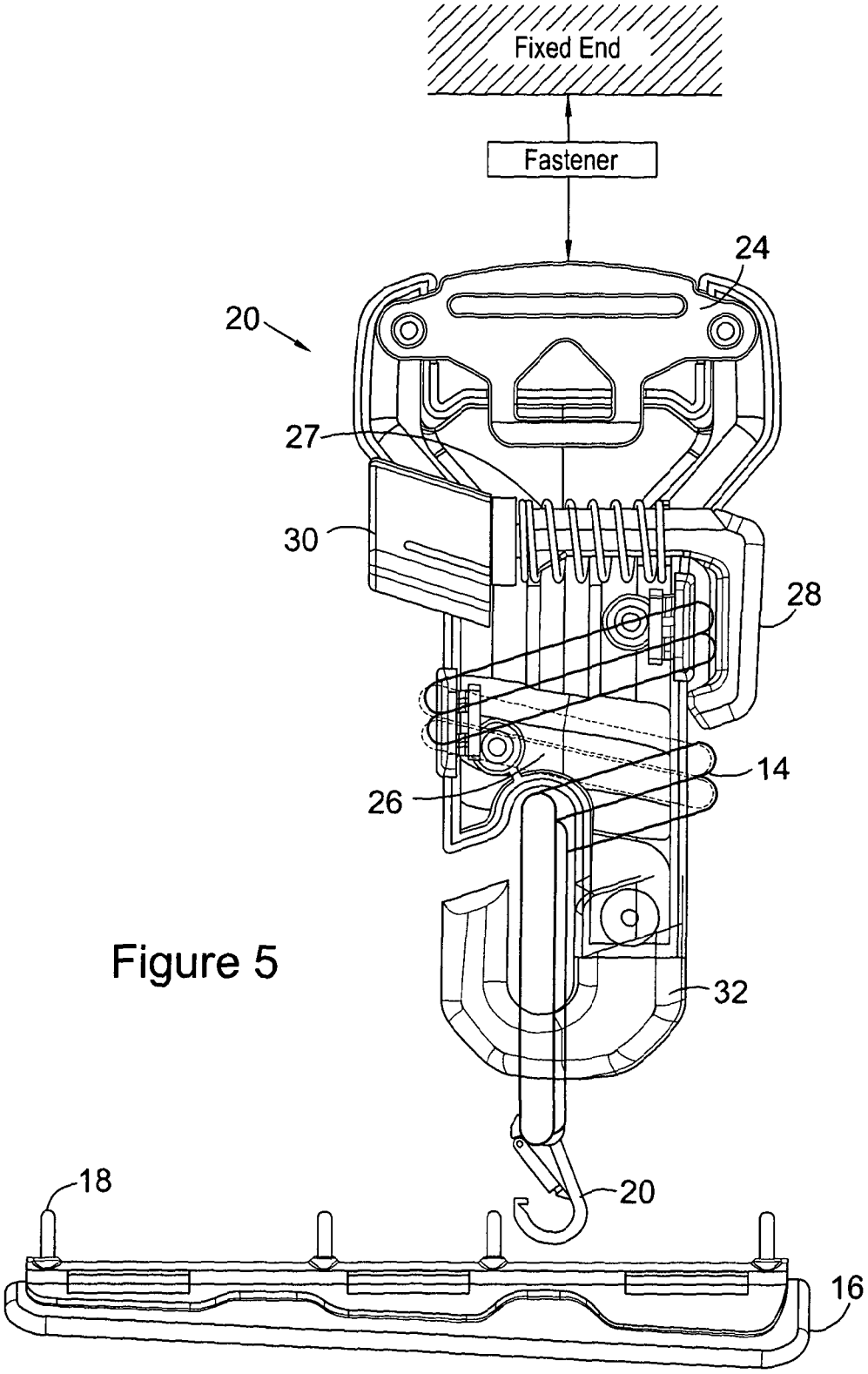
FIG. 5 is an internal view of the mechanical components of the clip of FIG. 4.
Figure 6:
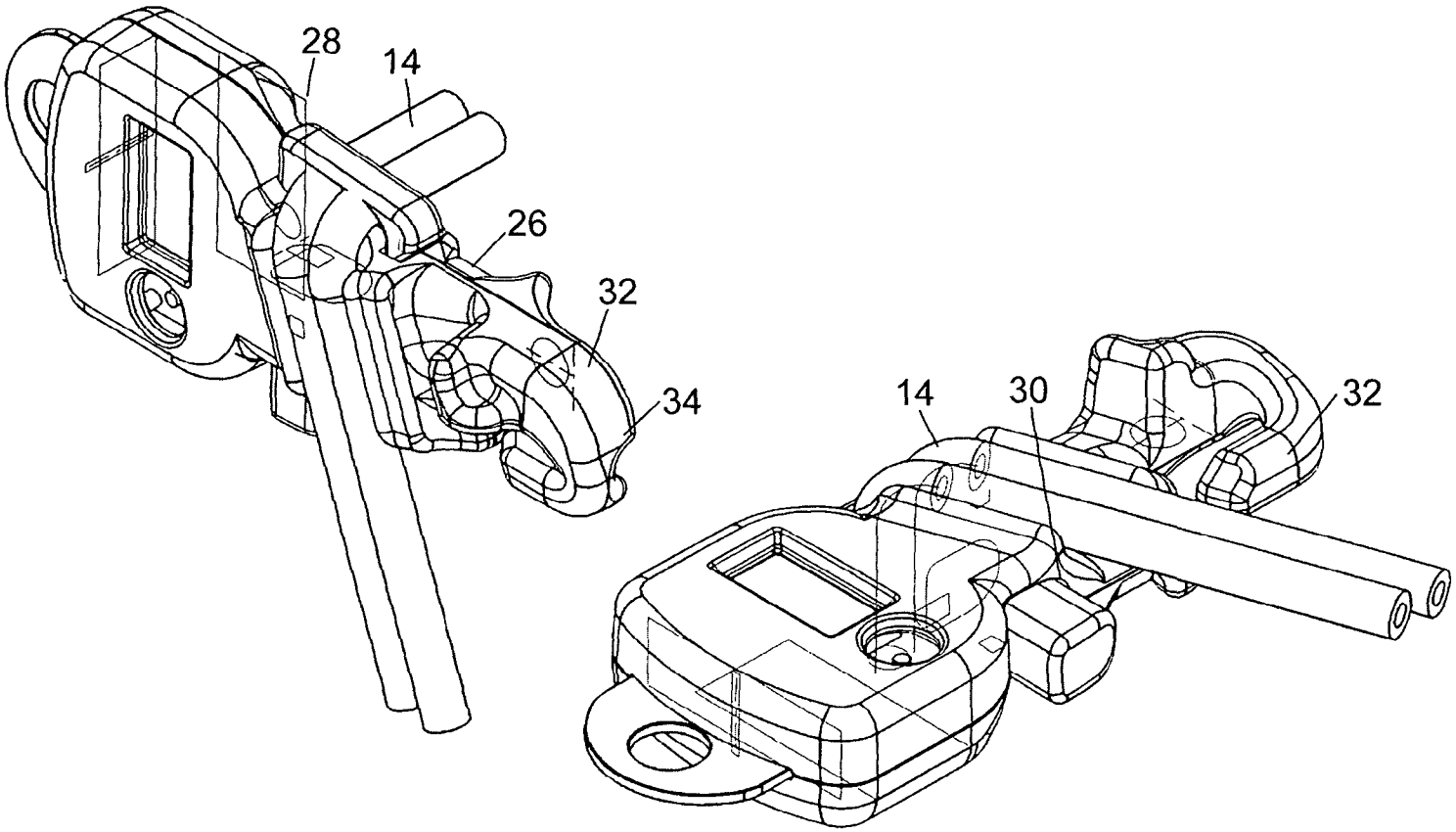
FIG. 6 is two perspective views of a clip to which a resilient band is being fitted.
Figure 7A:
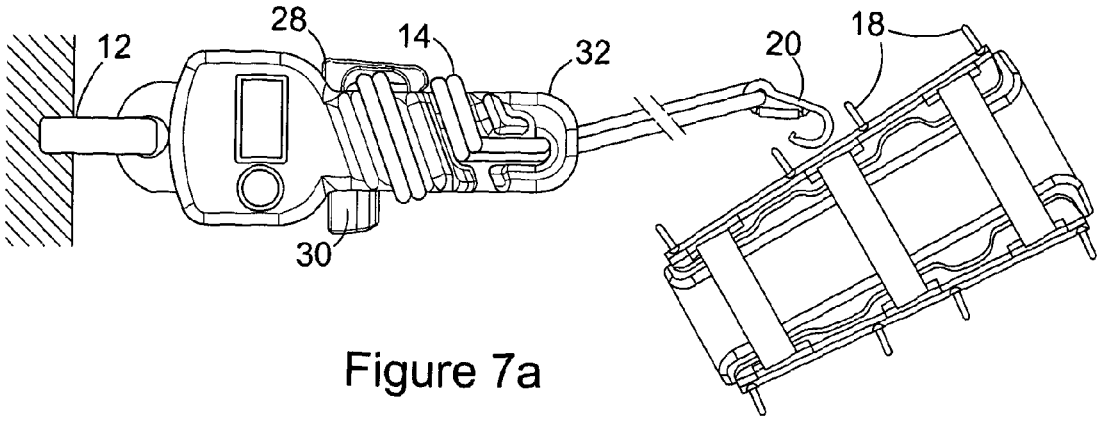
FIG. 7(*a*) is a front view of an active clip with tubing attached and shown in proximity to a leg/arm sleeve.
Figure 7B:
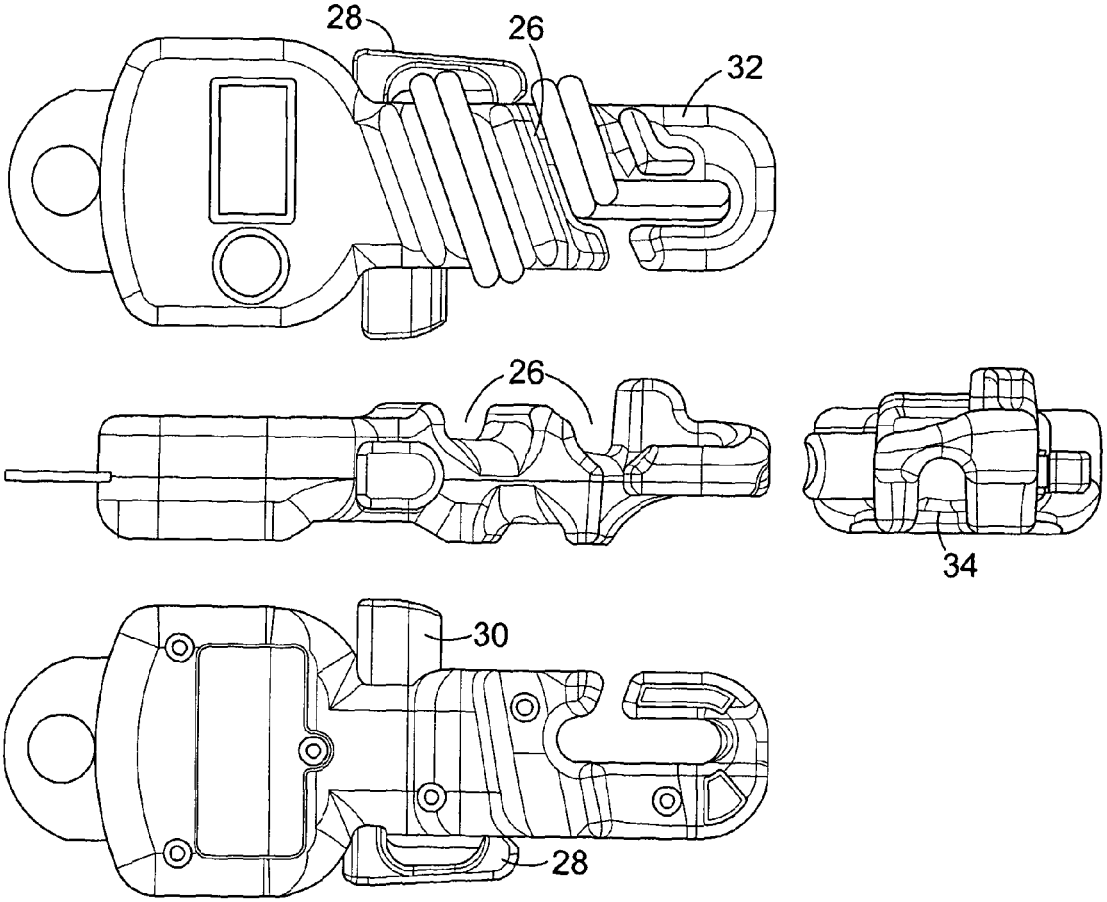
Figure 8:
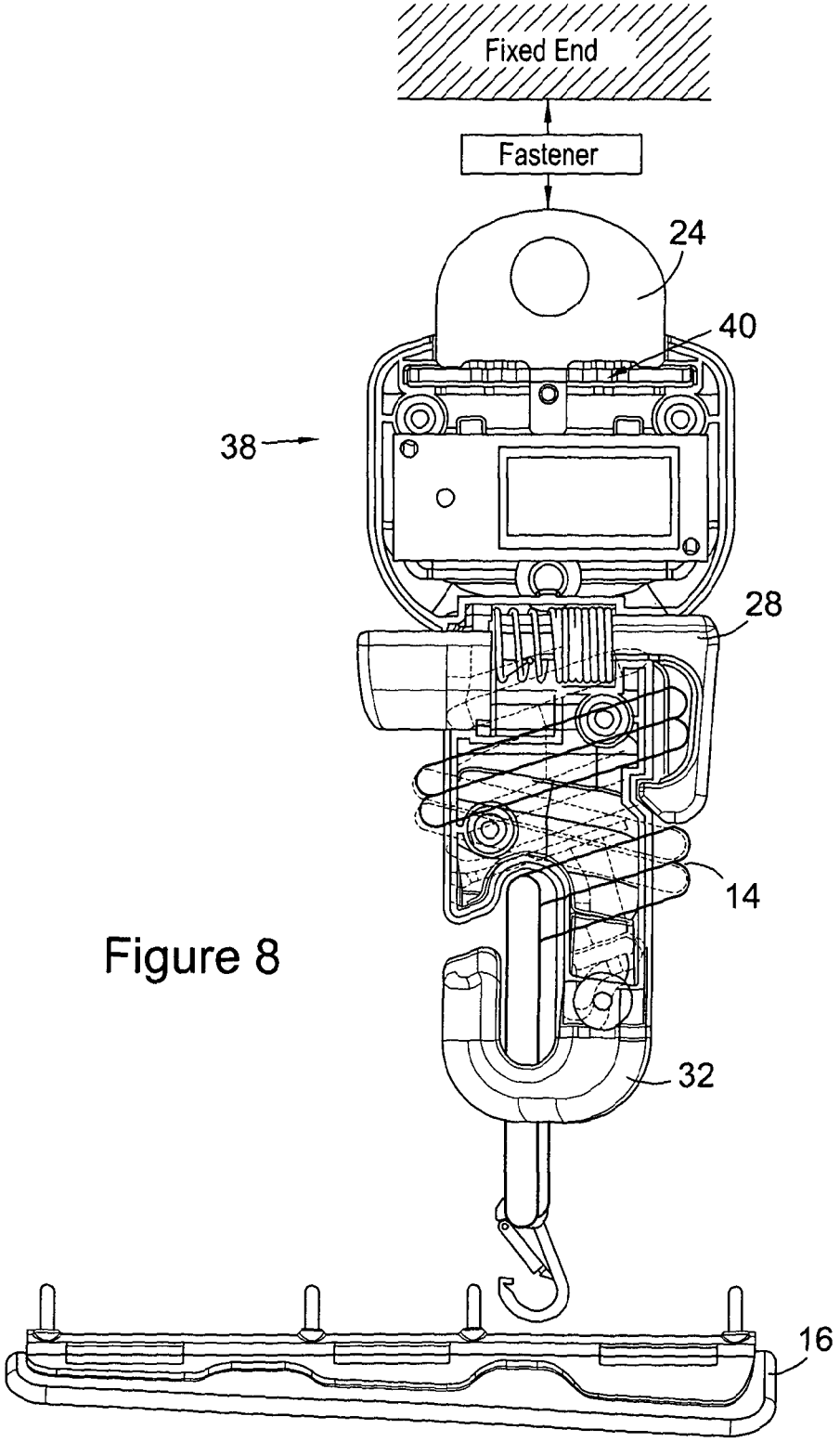
FIG. 8 is an internal view of the mechanical components of the clip of FIG. 7.
Figure 9:
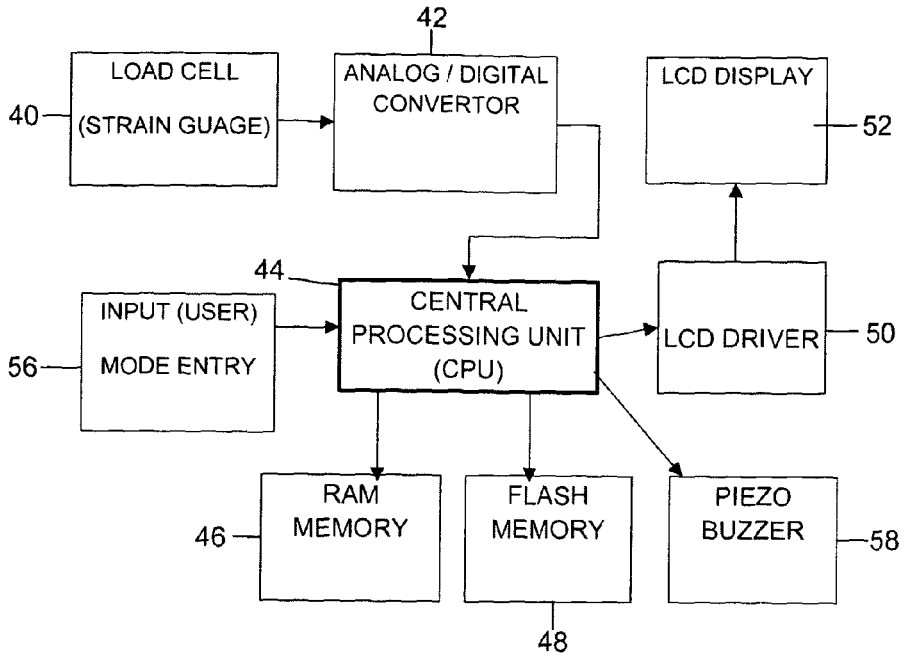
FIG. 9 is a schematic view of the internal electrical components of the active device of FIGS. 6 and 7.

FIGS. 3 to 9 show the clip 10 in more detail. The clip 10 can take two forms: a "dummy" clip, as shown in FIGS. 3 to 6, which may be used when an electronic reading is not required or an "active" clip, as shown in FIGS. 7 to 9, which can be programmed by the user to a number of modes depending on the exercise regime. Both have the same basic external structure. Each has a main body portion round which is formed a groove that is shaped to accommodate the resilient band; a mechanical coupling, for example a hanger plate, to allow connection of the clip to a fixed point; and a guide portion to guide the band so that it extends beyond the end of the clip in a direction substantially along the clip's axis.

Figure 4A:
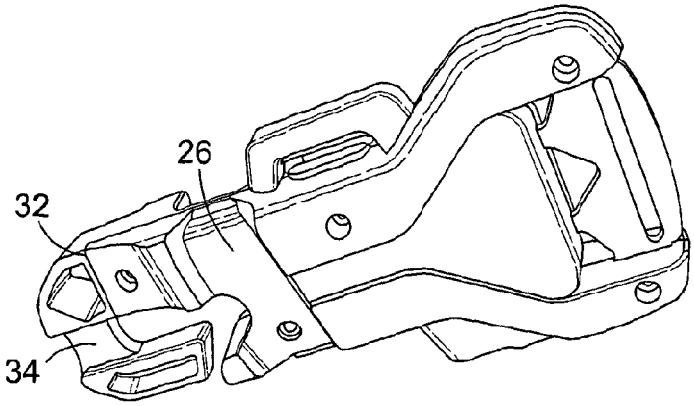
FIG. 4(*a*) is a rear view of another dummy clip.
Figure 4B:
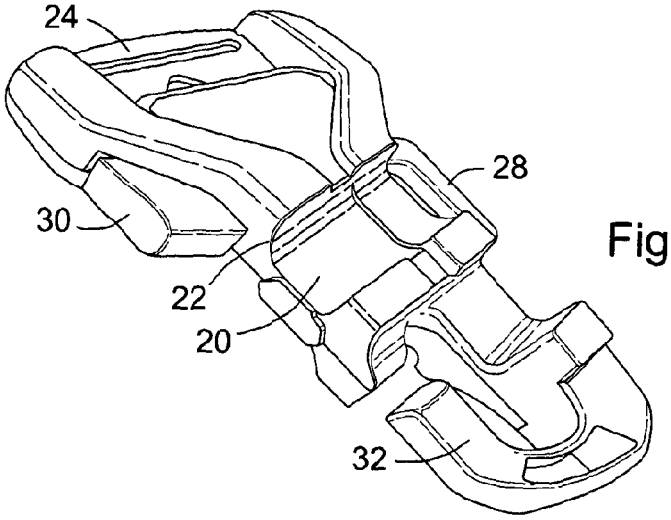

FIGS. 3 to 5 show views of two dummy clips 20. In each case, the clip has a main body portion 22. Mechanically coupled to the body portion 22 is a hanger plate 24 for allowing the clip 20 to be connected to a fixed external point. The hanger plate/coupling arrangement 24 of FIG. 3 is slightly different from that of FIG. 4, although the basic mechanical requirements are the same. Formed round the clip 20 is a groove 26 that spirals round the main body 22. In this case, the spiral groove 26 is shaped to accommodate two widths of the band 14. The profile and number of turns of the spiral groove 26 is important in providing an evenly distributed grip on the rubber tubing 14. This is the primary means of securing the rubber tubing 14. In the example shown in FIGS. 3 and 4, the groove 26 winds round the main body portion twice.

Extending over part of the groove 26 is a spring loaded, button activated lever 28. This can be most clearly seen in FIG. 5. This is arranged to locate and grip the rubber tubing 14 to provide an initial fixing point whilst the tubing 14 is loaded into the device 20. The spring loaded lever 28 is designed to be easy to activate with one hand whilst the user guides the tube with the other. The lever 28 is resiliently biased towards a closed positioned by the spring 27. A button 30 is provided in contact with an end of the lever 28 and engages the spring 27. When the button 30 is pressed, the spring 27 is compressed and the lever 28 moves to an open position to allow insertion of the tubing 14. When pressure is removed from the button 30, the lever 28 is biased towards a closed position, in which it is positioned relative to the main body 22 of the clip 20 to define a gap that is slightly smaller than the width of the resilient band 14. This means that when lever 28 is moved to its open position and the ends of the band 14 are positioned in the gap, and the lever 28 is subsequently moved to its closed position, the band 14 is partially compressed and held in place. This prevents the band 14 slipping out of engagement with the clip 20. By virtue of its spring loaded design, the lever 28 is able to accept various thicknesses of tubing. In this way, the lever 28 provides resistance to the pull out forces when load is applied to the tubing 14 during operation.

At the end of the main body of the clip of FIGS. 3 and 4 a guide 32 is provided to guide the resilient band 14 in such a way as to ensure it is aligned with the main axis of the clip 20. The guide 32 has a hook part, through which the band 14 is looped in use. On one side of the hook part, a guide or channel 34 is formed for receiving the resilient band 14 (in this case a double width of the band). This can be seen most clearly in FIG. 4(*a*). The spiral groove ends at the end of the body so that it opens into an inner part of the hook. The hook is shaped to define a path that forces the rubber tubing to be fed through in a direction opposite to that from the applied force, in this case in a direction along the main axis of the clip 20. The opening defined by the hook is sized so that the tubing 14 must be stretched thinner to allow it to pass through.

In use, the resilient band 14 is pushed into the space between the lever 28 and the main body 22 and the lever 28 is released so that it moves to its closed, clamping position. The band 14 is then wound round the path defined by the spiral groove 26 and through the hook 32 to the other side of the clip 20, where is it slots into the guide path 34 formed at the end of the hook, as shown in FIG. 6. This is a very simple and secure way of releasably attaching the band 14 and the clip 20. Once the band 14 is secured to the clip 20, the other end of the band is connected to a sleeve 16 on the patient/sportsperson and the clip 20 is connected to the fixed point 12 using any suitable fastener that can be attached to the hanger plate 24.

The dummy clip 20 of FIGS. 3 to 6 can be used for many exercises, and simplifies and increases the range of exercises possible. In some circumstances, however, objective data is needed. To provide this, the active clip of FIGS. 7 to 9 can be used. In addition to the features described above, this includes a strain gauge for measuring and monitoring the load applied, and a processor for controlling and processing the measurements.

FIG. 8 shows the mechanical components of the active clip 38 in more detail. This has a strain gauge 40 located at the end of the clip 38 remote from the hook 32. The strain gauge 40 is mechanically coupled to the main body portion 22 and the hanger plate 24. The hanger plate 24 provides a load bearing substrate to the strain gauge 40 circuits and a means of fixing the clip 38 to a fixed point or static object 12 via a through hole, which can accept a fastener, for example a carabineer or fabric loop. Strain transmitted through the clip 38 by tensioning of the resilient band 14 is transmitted through and measured by the strain gauge 40. The assembly is such that no influence is imposed on the strain gauge 40 other than transmitting the applied load from the tubing to the gauge. Connected to the strain gauge 40 are various electrical components for capturing and storing strain data.

FIG. 9 shows the electrical components of the active clip 38 in more detail. From this it can be seen that the strain gauge 40 is connected to an ADC 42 that is in turn connected to a central processing unit 44. The processor 44 is operable to receive signals indicative of strain readings from the strain gauge via the ADC 42. The Processor is connected to RAM memory 46 and FLASH memory 48, where the strain measurements can the stored. The processor 44 is also connected to an LCD driver 50 for driving an LCD display 52, where measurement results and/or instructions to users can be displayed. To allow a user to interact with the device, the processor 44 is additionally connected to a user input device 56 to allow user to input information, such as mode selection, and a device for generating sound 58, for example a piezo buzzer, so that audible instructions can be provided to a user.

The processor 44 controls the functionality of the active device 38. It is adapted to cause the LCD to display a menu to a user. The menu can provide various different options to a user, such as mode of use. Examples of modes include: a repetitions mode; a sets mode and a results mode. A button is provided to allow a user to toggle between the three modes. In the repetitions mode, the number of repetitions of an exercise can be set, as well as the force required to demonstrate completion of that exercise. The output of the strain gauge 44 is monitored to, assess the number of times an exercise is repeated. This is compared with the pre-set number stored in the memory. As and when the pre-set number and the measured number match, an audible or visual alarm is generated so the user knows that the exercise is completed.

In the sets mode, the user can select how often a group of repetitions has to be repeated. In this case, the user selects the number of sets and the number of repetitions within each set. When the exercise session starts, completion of each repetition and each set is monitored and compared with the pre-set numbers. At each stage the user can be given an audible or visual signal when the processor determines that a set is completed. The results mode allows the maximum force and the average force to be calculated and displayed to the user.

The active clip arrangement allows measurement of the forces produced through the resistance tubing 14. The electrical components can be adapted to record peak and average forces, in addition to providing audible identification of completed sets, the stipulation of repetitions, work: rest ratios, and sets to be completed.

To improve access to data from the active clip, the clip may include a wireless transmitter (not shown), so that data can be sent to a remote location for storage and analysis. Alternatively or additionally, the clip could be fitted with a USB connector so that data can be downloaded as and when desired. This can either be done using a memory stick or other such memory device or by adapting the clip to mate with a suitably connected telecoms cradle to allow data to be transferred to another device for analysis.

Figure 10:
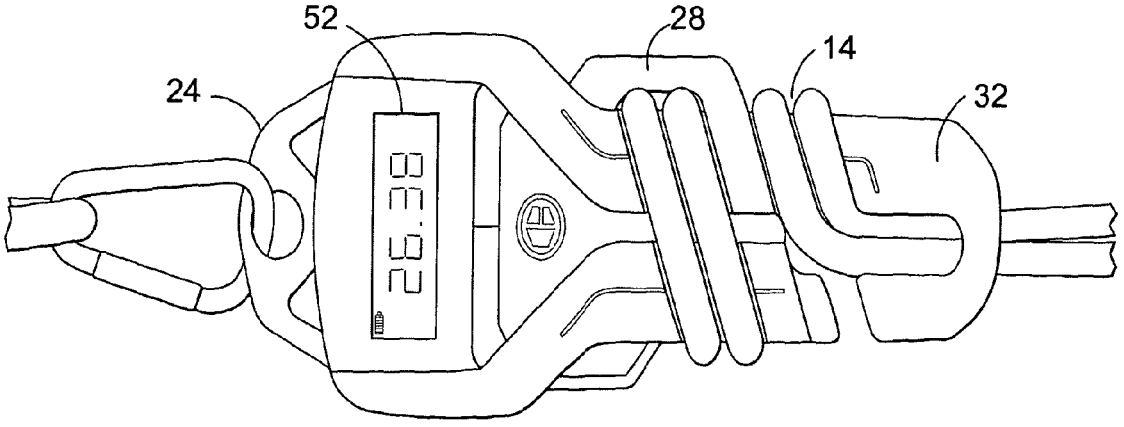
FIG. 10 is a front view of an active device in which a resilient band, is fitted.

In use of the active clip 38, the resilient band is pushed into the space between the lever and the main body 22 and the lever 28 is released so that it moves to its closed, clamping position. The band 14 is then wound round the path defined by the spiral groove and through the hook to the other side of the clip, where is it slots into the guide path 34 formed at the end of the hook 32, so that the band 14 extends along an axis of the main body portion of the clip 38, as shown in FIG. 10. Once connected to the clip 38 and the appropriate sleeve 16, the band 14 can be used. This involves tensioning the band. Strain along the band is transmitted to the main body part, and from there to the strain gauge 40 and hanger plate 24, so allowing a measure of the applied force.

Numerous exercises can be done using the device of the invention either with a single clip and band or with more complex multi-clip/multi-band arrangements. A few examples will be described, but it will be appreciated that a wide range of other options is possible.

For upper limb exercises, the upper limb forearm sleeve has to be attached to the forearm (say right); the clip (active or dummy) is attached to the forearm sleeve and the flexible band is attached to the clip by winding it round the spiral groove. The clip is then attached to a suitable fixed anchor point. Once this is done, the user stands side on to the door with his (Left) foot closest to door, and the right palm of the hand facing left knee. Various exercises can be done from this position. For example: Bring Hand up and across the body in a diagonal fashion ending with (Right) palm now facing outwards with arm bent to side of the head and repeat. If the active clip is used the number of repetitions can be set and the user prompted to repeat the actions by causing the buzzer to sound. This exercise is ideal for those recovering from shoulder or arm injury/surgery (Rehabilitation).

Many lower limb exercises can be done. For example, for a kicking exercise, the lower limb sleeve is attached to the (Right) shank, and to an active load meter clip. A lower limb sleeve is attached to a dummy clip. An upper limb sleeve is attached to the (left) forearm and to a dummy clip. Flexible bands are then attached to each of the clips and the ends of the bands held securely at a fixed point. This can be done by attaching the clips to a secure fixing. Alternatively, for on-pitch situations the coach could hold the ends of the clips. The exercise begins by having the athlete start by swinging their (right) leg behind their body at same time as their other (Left) arm is moved backwards. At this stage there is no tension on the resistance tubing: this resistance occurs and increases through the next (kicking) phase. The athlete then swings his (Right) foot through in the diagonal pattern he would employ if striking a ball, as his (Left) arm simultaneously crosses in front of the body. This exercise is ideal for kicking warm-up pre-match or training, or those seeking to enhance closed skills of kicking (Performance).

Dynamic exercises can also be done, for example mirroring and passing exercises. In this case, an upper limb sleeve is attached to each forearm and a dummy clip is attached to both. A flexible band is attached to each and to door anchors on the floor and at the top of a door. The athlete then faces the therapist/coach and has to mirror the actions of the therapist/coach as he moves hands up high, down low, wide, narrow, forward, back. This stimulates a response as the tension from above and below alters in response to the changing stimulus. Alternatively the stimulus could be verbal and have the athlete perform the activities with eyes closed. With the eyes open, the stimulus can be further changed with a ball being passed rather than pure mirroring, and have the ball returned to therapist/coach. This exercise is ideal for those using two hands for sporting activities, such as goalkeepers or basketball players, or those recovering from shoulder injury or surgery requiring end stage activity (Performance or Rehabilitation).

The system of the present invention provides numerous advantages making it suitable for medical and sports training applications. For example, it is portable and easy to use allowing for home use by patients, effectively still under the safe direction of the health care professional with little setup required. In addition, the system provides flexibility, because it allows different sleeves to be attached to different body cylinders during different stages of the rehabilitation process. This can help optimise recovery time. Using the data provided by the load cell components in the active clip, readings give a baseline force production, whilst ongoing readings accurately chart progressions, guide rehabilitation programmes and assist the prescription of exercise.

Using the system to focus on hip joint mechanics, stability around the hip and knee as well as proprioceptive demands, each of the stages of the rehabilitation from a knee injury (e.g Early, mid/end/functional/strengthening) can be enhanced. Tasks can be altered by modifying the fixation points. Changing the pull of the elastic resistance bands introduce simultaneous assisted and resisted exercises, thus increasing the neuromuscular adaptations. The relationship between glutes/hamstring/quads could be established and enhanced in the early stages providing proximal control. This may be assisted by a thigh sleeve. Assisted/resisted exercises are beneficial in this phase, and would be demonstrably improved with sleeve attachments. Proprioceptive exercises can be performed with a trunk attachment in place. During the mid stage of the rehabilitation process, open kinetic chain exercises are introduced, which demand control through range. Trunk, arm and leg sleeves could thus be concurrently employed to incorporate the isolated movements into part of the system of slings within the body.

The invention is also ideal for sport- or task-related functions under the tension of the bands. This may include closed skill tasks such as kicking or throwing. These may be enhanced by further challenging the system under increasing elastic tension. These may be carried through as a field challenge, by using the system in a warm-up method of dynamic flexibility of joints, working through their entire range prior to athletic activity.

Programmes can be set within the device for monitoring by the referring physiotherapist to chart progress and assess suitability of the current programme. The system has been designed to be safely and easily set up in the patient/athlete home. Key aspects of the design allow for reliable exercise reproduction each time the patient follows the physiotherapist instructions. The patient is aided in conducting the home exercise programme by the capacity of the clip to produce audio sounds on completion of a set task, thus aiding adherence. The memory capacity of the clip enables data from a series of exercise bouts to be stored internally and retained during power down periods. These can then be readily accessed by the clinician and manually recorded into the patient's medical records by the physiotherapist on their return to the original clinical setting.

A skilled person will appreciate that variations of the disclosed arrangements are possible without departing from the invention. For example, whilst the invention is intended mainly for medical or sports training purposes, there may be applications within the military, computer gaming, and test-simulation environments. Also, the invention may be used with elderly patients. In the research and development sector, loads on the body can be readily investigated by the use of the system. Accordingly the above description of the specific embodiment is made by way of example only and not for the purposes of limitation. It will be clear to the skilled person that minor modifications may be made without significant changes to the operation described.

The invention claimed is:

1. A muscle development system comprising:

a clip for attaching a resilient band to a fixed point; and a sleeve for fitting round a body part of a user of the muscle development system, wherein:

the sleeve has at least one attachment device for allowing attachment of the resilient band to the sleeve, the clip has a body part shaped to allow the resilient band to be securably and at least one of releasably spirally or releasably helically wound round the clip, the body part of the clip has at least one groove that defines at least one of a spiral or a helical pathway inset on an external surface and configured for accommodating the resilient band along at least part of a length thereof; and a fastener is provided on the clip for fastening the resilient band onto a portion of the clip, the fastener comprising a lever that is operable to releasably fasten the band to the clip.

2. A system as claimed in claim 1, wherein the resilient band is releasably connectable between the clip and sleeve.

3. A system as claimed in claim 1, wherein the lever is spring loaded, and biased towards a fastening position.

4. A system as claimed in claim 3, wherein the lever comprises a button activated lever comprising a button for releasing the lever from the fastening position of the lever.

5. A system as claimed in claim 1, comprising a load meter.

6. A system as claimed in claim 5, wherein the load meter is a strain gauge.

7. A system as claimed in claim 5, wherein the load meter is included in the clip.

8. A system as claimed in claim 5, comprising at least one of mechanical or electrical components to record force generation through the resilient band.

9. A system as claimed in claim 8, comprising at least one of mechanical or electrical components for recording at least one of a peak or an average force generation through the resilient band.

10. A system as claimed in claim 5, wherein the clip includes a processor for processing data from the load meter.

11. A system as claimed in claim 10, wherein the clip includes a memory located within wherein the processor is operable to cause the data to be stored in the memory.

12. A system as claimed in claim 1, wherein the sleeve is made of fabric.

13. A system as claimed in claim 1, wherein one or more flexible loops or clips are positioned on the sleeve to allow the resilient band to be connected.

14. A system as claimed in claim 13, wherein the loops or clips may be on at least one of the front, the back, the top, the bottom, the inside, or the outside of the sleeve.

15. An exercise/muscle development system comprising multiple clips and multiple sleeves for fitting round multiple body parts of users of the exercise/muscle development system, wherein; the multiple clips and sleeves are configured to be used in pairs to allow a resilient band to be releasably connected between them, each sleeve has at least one attachment device for allowing attachment of the resilient band to the sleeve, each clip has a body part shaped to allow the resilient band to be securably and at least one of releasably spirally or releasably helically wound round the clip, the body part of the clip has at least one of a spiral or a helical groove that winds transversely around an external surface of the body part, the transversely wound spiral or helical groove is configured for accommodating the resilient band along at least part of a length thereof; and a fastener is provided on the clip for fastening the resilient band onto a portion of the clip, the fastener comprising a lever that is operable to releasably fasten the band to the clip.

16. An exercise/muscle development system as claimed in claim 15, wherein at least one of the clips has a load meter.

17. An exercise/muscle development system as claimed in claim 16, wherein the load meter is a strain gauge.

* * * * *